US006432297B1

(12) United States Patent
Kalnes et al.

(10) Patent No.: US 6,432,297 B1
(45) Date of Patent: Aug. 13, 2002

(54) METHOD TO PRODUCE LUBE BASESTOCK

(75) Inventors: Tom N. Kalnes, La Grange; Vasant P. Thakkar, Elk Grove Village, both of IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 09/692,970

(22) Filed: Oct. 23, 2000

(51) Int. Cl.[7] ..... C10G 47/00; C10G 65/00; C10G 69/02

(52) U.S. Cl. ..... 208/58; 208/60

(58) Field of Search ..... 208/58, 60

(56) References Cited

U.S. PATENT DOCUMENTS 4,194,964 A 3/1980 Chen et al. ..... 208/108
5,358,627 A * 10/1994 Mears et al. ..... 208/59
5,980,729 A 11/1999 Kalnes et al. ..... 208/89

* cited by examiner

*Primary Examiner*—Thuan D. Dang
(74) *Attorney, Agent, or Firm*—John G. Tolomei; James C. Paschall; John G. Cutts, Jr.

(57) ABSTRACT

A process for the production of lube oil basestock wherein a high boiling hydrocarbonaceous feedstock is hydrocracked to produce hydrocarbons boiling in the range of lube oil basestock and the resulting hydrocracker effluent is hot, hydrogen stripped to remove lower boiling hydrocarbons and hydrogen sulfide before being introduced into a hydrodewaxing zone. In a preferred embodiment the hot hydrogen stripper contains a hydrogenation zone conducted at "sweet" hydrogenating conditions which permits the subsequent use of sulfur sensitive catalysts in downstream reaction zones including hydrodewaxing and hydrofinishing reaction zones. Preferably, the effluent from the hydrodewaxing reaction zone is immediately further processed in a hydrofinishing reaction zone.

32 Claims, 1 Drawing Sheet

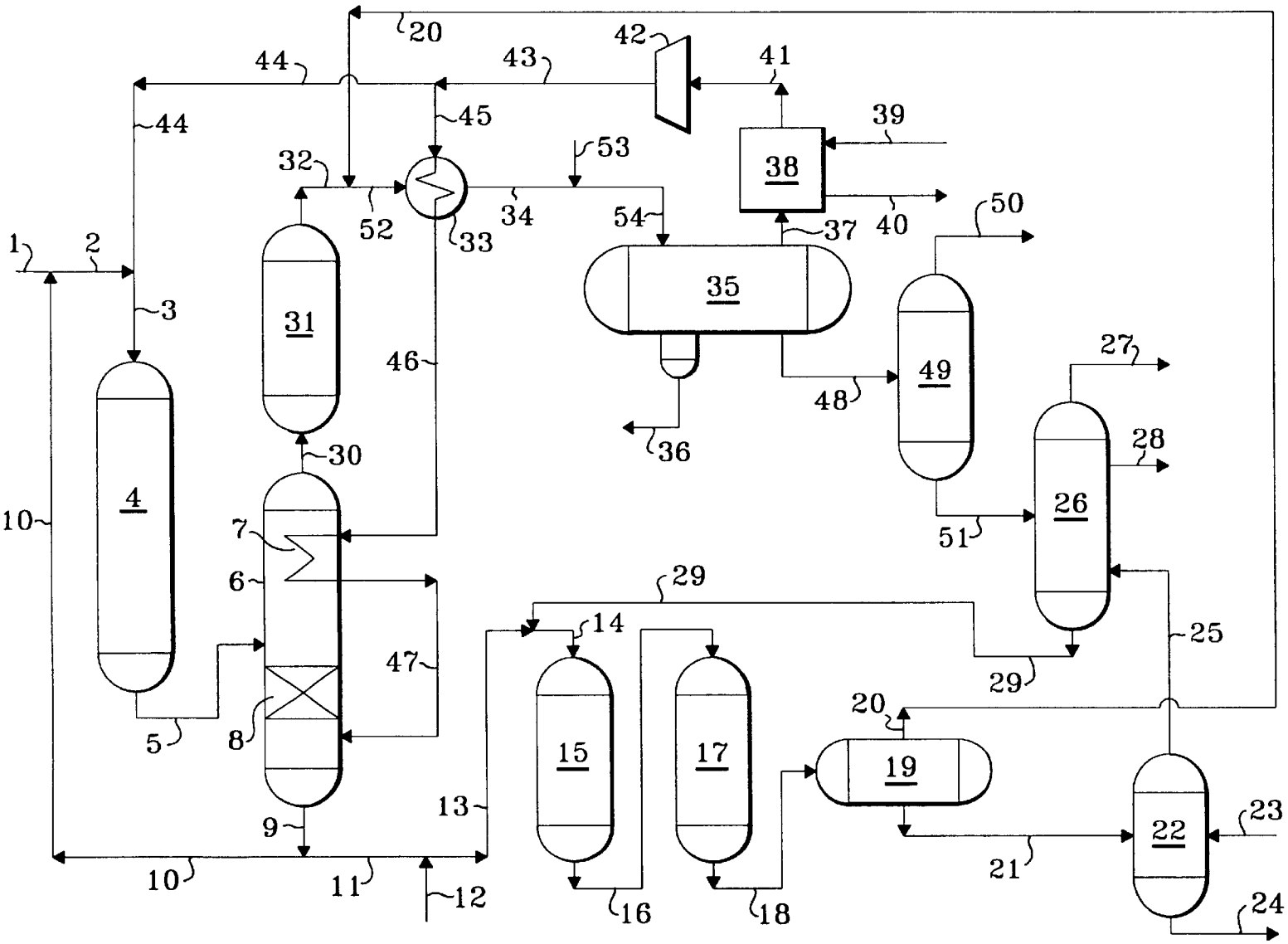
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51
52
53
54

METHOD TO PRODUCE LUBE BASESTOCK

BACKGROUND OF THE INVENTION

The field of art to which this invention pertains is the hydrocracking of a hydrocarbonaceous feedstock to produce lube basestock. Petroleum refiners often produce desirable products such as lube basestock by hydrocracking a hydrocarbon feedstock derived from crude oil, for example. Feedstocks most often subjected to hydrocracking are gas oils and heavy gas oils recovered from crude oil by distillation. A typical gas oil comprises a substantial portion of hydrocarbon components boiling above about 700° F., usually about 50 percent by weight boiling above 700° F. A typical vacuum gas oil normally has a boiling point range between about 600° F. and about 1050° F.

Hydrocracking is generally accomplished by contacting in a hydrocracking reaction vessel or zone the gas oil or other feedstock to be treated with a suitable hydrocracking catalyst under conditions of elevated temperature and pressure in the presence of hydrogen so as to yield a product containing lube basestock.

Although a wide variety of process flow schemes, operating conditions and catalysts have been used in commercial activities, there is always a demand for new methods including hydrocracking to produce lube basestock which provide lower costs and higher product yields and quality. The integrated process of the present invention improves the economics for the production of lube basestocks.

INFORMATION DISCLOSURE

U.S. Pat. No. 5,980,729 (Kalnes et al) discloses a hydrocracking process which utilizes a hot, high-pressure stripper.

U.S. Pat. No. 4,194,964 (Chen et al) discloses a process for the simultaneous distillation and hydrocracking of hydrocarbon feeds in a single vessel.

BRIEF SUMMARY OF THE INVENTION

The present invention is a process for the production of lube oil basestock wherein a high boiling hydrocarbonaceous feedstock is hydrocracked to produce hydrocarbons boiling in the range of lube oil basestock and the resulting hydrocracker effluent is hot, hydrogen stripped to remove lower boiling hydrocarbons and hydrogen sulfide before being introduced into a hydrodewaxing zone. In a preferred embodiment the hot hydrogen stripper contains a hydrogenation zone conducted at "sweet" hydrogenating conditions which permits the subsequent use of sulfur sensitive catalysts in downstream reaction zones including hydrodewaxing and hydrofinishing reaction zones. Preferably, the effluent from the hydrodewaxing reaction zone is immediately further processed in a hydrofinishing reaction zone.

In accordance with one embodiment, the present invention relates to a method to produce lube oil basestock from a hydrocarbonaceous feedstock which method comprises: (a) contacting the hydrocarbonaceous feedstock and a hydrogen-rich gaseous stream in a hydrocracking zone with a hydrocracking catalyst at a temperature from about 400° F. to about 900° F., a pressure from about 500 psig to about 2500 psig, and a liquid hourly space velocity from about 0.1 $hr^{-1}$ to about 15 $hr^{-1}$; (b) passing the effluent stream from the hydrocracking zone directly to a hot, high-pressure stripper utilizing a hot, hydrogen-rich stripping gas to produce a first vapor stream comprising hydrogen, hydrogen sulfide, ammonia and hydrocarbonaceous compounds boiling at a temperature below the boiling range of the lube basestock, and a first liquid stream comprising hydrocarbonaceous compounds boiling in the range of the lube basestock and saturated with hydrogen; (c) passing at least a portion of the first liquid stream and a hydrogen-rich gaseous stream to a catalytic hydrodewaxing zone to reduce the pour point of the first liquid stream; and (d) separating the resulting effluent from the catalytic hydrodewaxing zone to produce lube basestock.

In accordance with another embodiment, the present invention relates to a method to produce lube oil basestock from a hydrocarbonaceous feedstock which method comprises: (a) contacting the hydrocarbonaceous feedstock and a hydrogen-rich gaseous stream in a hydrocracking zone with a hydrocracking catalyst at a temperature from about 400° F. to about 900° F., a pressure from about 500 psig to about 2500 psig, and a liquid hourly space velocity from about 0.1 $hr^{-1}$ to about 15 $hr^{-1}$; (b) passing the effluent stream from the hydrocracking zone directly to a hot, high-pressure stripper utilizing a hot, hydrogen-rich stripping gas to produce a first vapor stream comprising hydrogen, hydrogen sulfide, ammonia and hydrocarbonaceous compounds boiling at a temperature below the boiling range of the lube basestock, and a downwardly flowing liquid comprising hydrocarbonaceous compounds boiling in the range of the lube basestock; (c) simultaneously contacting the downwardly flowing liquid in the hot, high-pressure stripper with a hydrogenation catalyst and an upwardly flowing hydrogen stream to produce a first liquid stream comprising hydrocarbonaceous compounds boiling at a temperature in the range of the lube basestock and saturated with hydrogen; (d) passing at least a portion of the first liquid stream and a hydrogen-rich gaseous stream to a catalytic hydrodewaxing zone to reduce the pour point of the first liquid stream; and (e) separating the resulting effluent from the catalytic hydrodewaxing zone to produce lube basestock.

In yet another embodiment, the present invention relates to a method to produce lube oil basestock from a hydrocarbonaceous feedstock which method comprises: (a) contacting the hydrocarbonaceous feedstock and a hydrogen-rich gaseous stream in a hydrocracking zone with a hydrocracking catalyst at a temperature from about 400° F. to about 900° F., a pressure from about 500 psig to about 2500 psig, and a liquid hourly space velocity from about 0.1 $hr^{-1}$ to about 15 $hr^{-1}$; (b) passing the effluent stream from the hydrocracking zone directly to a hot, high-pressure stripper utilizing a hot, hydrogen-rich stripping gas to produce a first vapor stream comprising hydrogen, hydrogen sulfide, ammonia and hydrocarbonaceous compounds boiling at a temperature below the boiling range of the lube basestock, and a downwardly flowing liquid comprising hydrocarbonaceous compounds boiling in the range of the lube basestock; (c) simultaneously contacting the downwardly flowing liquid in the hot, high-pressure stripper with a hydrogenation catalyst and an upwardly flowing hydrogen stream to produce a first liquid stream comprising hydrocarbonaceous compounds boiling at a temperature in the range of the lube basestock and saturated with hydrogen; (d) passing at least a portion of the first liquid stream and a hydrogen-rich gaseous stream to a catalytic hydrodewaxing zone to reduce the pour point of the first liquid stream; (e) passing the effluent directly from the catalytic hydrodewaxing zone into a hydrofinishing reaction zone; and (f) separating the resulting effluent from the hydrofinishing reaction zone to produce lube basestock.

Other embodiments of the present invention encompass further details such as types and descriptions of feedstocks, hydrocracking catalysts, hydrodewaxing catalysts, hydrofinishing catalysts and preferred operating conditions including temperatures and pressures, all of which are hereinafter disclosed in the following discussion of each of these facets of the invention.

BRIEF DESCRIPTION OF THE DRAWING

The drawing is a simplified process flow diagram of a preferred embodiment of the present invention. The drawing is intended to be schematically illustrative of the present invention and not be a limitation thereof.

DETAILED DESCRIPTION OF THE INVENTION

It has been discovered that higher lube basestock product yields and lower cost of production can be achieved and enjoyed in the above-described method.

The process of the present invention is particularly useful for the production of lube basestock by hydrocracking a hydrocarbon oil containing hydrocarbons and/or other organic materials. The hydrocarbon feedstocks that may be subjected to hydrocracking and subsequent production of lube basestocks by the method of the invention include all mineral oils and synthetic oils (e.g., shale oil, tar sand products, etc.) and fractions thereof. Illustrative hydrocarbon feedstocks include those containing components boiling above 550° F., such as atmospheric gas oils, vacuum gas oils, deasphalted vacuum, and atmospheric residua, hydrotreated residual oils, coker distillates, straight run distillates, pyrolysis-derived oils, high boiling synthetic oils, cycle oils and cat cracker distillates. A preferred feedstock is a gas oil or other hydrocarbon fraction having at least 50% by weight, and most usually at least 75% by weight, of its components boiling at temperatures above the initial boiling point of the desired lube basestock. One of the most preferred gas oil feedstocks will contain hydrocarbon components which boil above 550° F. with best results being achieved with feeds containing at least 25 percent by volume of the components boiling between 600° F. and 1000° F.

The selected feedstock and a hydrogen-rich gaseous stream are introduced into a hydrocracking zone. The hydrocracking zone may contain one or more beds of the same or different catalyst. In one embodiment the preferred hydrocracking catalysts utilize amorphous bases or low-level zeolite bases combined with one or more Group VIII or Group VIB metal hydrogenating components. In another embodiment the hydrocracking zone contains a catalyst which comprises, in general, any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms ($10^{-10}$ meters). It is preferred to employ zeolites having a relatively high silica/alumina mole ratio between about 3 and 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8–12 Angstroms ($10^{-10}$ meters), wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 700°–1200° F. (371°–648° C.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The hydrocracking of the hydrocarbonaceous feedstock in contact with a hydrocracking catalyst is conducted in the presence of hydrogen and preferably at hydrocracking conditions which include a temperature from about 450° F. (232° C.) to about 875° F. (468° C.), a pressure from about 500 psig (3448 kPa gauge) to about 3000 psig (20685 kPa gauge), a liquid hourly space velocity (LHSV) from about 0.1 to about 30 $hr^{-1}$, and a hydrogen circulation rate from about 2000 (337 normal $m^3/m^3$) to about 25,000 (4200 normal $m^3/m^3$) standard cubic feet per barrel. In accordance with the present invention, the term "substantial conversion to lower boiling products" is meant to connote the conversion of at least 10 volume percent of the fresh feedstock.

After the hydrocarbonaceous feedstock has been subjected to hydrocracking as hereinabove described, the resulting uncooled effluent from the hydrocracking reaction zone is introduced into a hot, high-pressure stripping zone maintained at essentially the same pressure as the hydrocracking zone and contacted with a hot hydrogen-rich gaseous stream to produce a gaseous hydrocarbonaceous stream containing hydrocarbonaceous compounds boiling at a temperature below lube basestock and a first liquid hydrocarbonaceous stream containing hydrocarbonaceous compounds boiling in the range of lube basestock. The stripping zone is preferably maintained at a temperature in the range from about 450° F. to about 875° F. The effluent from the hydrocracking reaction zone is not substantially cooled and would only be lower in temperature due to unavoidable heat loss during transport from the reaction zone to the stripping zone. It is preferred that the cooling of the hydrocracking reaction zone effluent is less than about 100° F. By maintaining the pressure of the stripping zone at essentially the same pressure as the reaction zone is meant that any difference in pressure is due to the pressure drop required to flow the effluent stream from the reaction zone to the stripping zone. It is preferred that the pressure drop is less than about 100 psig.

In one embodiment, the lower end of the stripping zone contains a bed of hydrogenation catalyst which is operated at conditions including a pressure from about 500 psig to about 2500 psig, a temperature from about 300° F. to about 800° F. and a liquid hourly space velocity from about 0.1 $hr^{-1}$ to about 15 $hr^{-1}$. Any suitable known hydrogenation catalyst or catalysts may be utilized. An upwardly flowing hydrogen-rich gaseous stream is passed through the hydrogenation catalyst while countercurrently contacting the downwardly flowing liquid hydrocarbons. As a result, the concentration of hydrogen sulfide is kept low which creates a high performance, "sweet" hydrogenation reaction zone and produces a resulting liquid hydrocarbon containing a low sulfur concentration preferably less than about 50 ppm. The hydrogen-rich gas supplied to the stripping zone may be introduced entirely below the hydrogenation catalyst or may be bifurcated and introduced both above and below the hydrogenation catalyst. In any event, the total of the hydrogen-rich gas is preferably supplied in an amount greater than about 10 weight percent of the hydrocarbonaceous feedstock. A liquid hydrocarbonaceous stream is introduced into or produced in situ into an upper portion of the stripping zone in an amount of greater than about 1 weight percent of the hydrocarbonaceous feedstock as reflux. At least a portion of the resulting liquid hydrocarbonaceous stream recovered from the lower end of the stripping zone is introduced along with a hydrogen-rich gaseous stream into a catalytic hydrodewaxing zone to reduce the pour point of the liquid hydrocarbonaceous stream. Any suitable known hydrodewaxing catalyst may be utilized in the catalytic hydrodewaxing zone. Generally, there are two types of hydrodewaxing catalysts with the first functioning as a wax cracking catalyst and the second functioning as a wax isomerization catalyst. The catalytic hydrodewaxing zone is preferably operated at a temperature from about 250° F. to about 850° F. and a pressure from about 500 psig to about 2500 psig.

In a preferred embodiment, the effluent from the catalytic hydrodewaxing zone is introduced into a hydrofinishing zone to improve the lube basestock color and to hydrogenate trace olefinic hydrocarbons and multi-ring aromatic compounds thereby providing a more highly valued and premium lube basestock product. Any suitable known hydrogenation catalyst may be utilized in the hydrofinishing zone and this zone is preferably operated at a temperature from about 250° F. to about 700° F. and a pressure from about 500 psig to about 2500 psig.

The resulting effluent from the catalytic hydrodewaxing zone and in a preferred embodiment the effluent from the hydrofinishing zone is introduced into a hot, vapor-liquid separator preferably operated at a temperature from about 150° F. to about 650° F. to produce a vapor stream containing hydrogen and normally gaseous hydrocarbons which vapor stream is subsequently cooled and introduced into a cold vapor-liquid separator preferably operated at a temperature from about 40° F. to about 140° F. A liquid stream containing lube basestock hydrocarbons is preferably removed from the hot, vapor-liquid separator and steam stripped in a stripper to produce a lube basestock hydrocarbon stream which may then be further processed into finished lubricating oil.

The gaseous hydrocarbonaceous stream containing hydrocarbonaceous compounds boiling at a temperature below lube basestock produced in the hot, high-pressure stripping zone is preferably passed to a post-treat hydrogenation zone to saturate aromatic compounds. Any suitable known hydrogenation catalyst may be utilized in the post-treat hydrogenation zone and this zone is preferably operated at a temperature from about 450° F. to about 800° F. The resulting effluent from the post-treat hydrogenation zone is cooled, partially condensed and introduced into the hereinabove-described cold vapor-liquid separator. A hydrogen-rich gaseous stream containing hydrogen sulfide is removed from the cold vapor-liquid separator and preferably passed through an acid gas scrubber to recover the hydrogen sulfide before being compressed and at least a portion passed to the hydrocracking zone. Another portion is heated preferably with heat-exchange in the hot, high-pressure stripper and is subsequently introduced into the lower end of the hot, high-pressure stripper as stripping medium. A liquid stream containing hydrocarbons boiling below the temperature of the lube basestock and a lesser quantity of hydrocarbons boiling in the range of the lube basestock is removed from the cold vapor-liquid separator and introduced into a cold flash drum to recover a gaseous stream containing normally gaseous hydrocarbons and a liquid stream which is introduced into a fractionation zone to produce one or more product streams boiling at a temperature below that of lube basestock and a bottom stream containing lube basestock hydrocarbons which is preferably introduced into the hydrodewaxing zone.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to the drawing, a feed stream comprising vacuum gas oil is introduced into the process via line 1 and admixed with a liquid hydrocarbon recycle stream provided via line 10 and the resulting admixture is transported via line 2 and is joined with a hydrogen-rich gaseous stream provided via line 44 and this resulting admixture is introduced via line 3 into hydrocracking zone 4. A hydrocracked hydrocarbon stream having components boiling in the range of lube basestock is recovered from hydrocracking zone 4 via line 5 and is introduced into stripping zone 6. A hydrogen-rich gaseous stream is introduced as a stripping gas via line 47 into stripping zone 6 and is passed upwardly through hydrogenation zone 8 to produce a gaseous stream effluent containing hydrocarbonaceous compounds boiling in a range below lube basestock which is removed via line 30 from stripping zone 6 and is introduced into aromatic saturation zone 31. The resulting effluent from aromatic saturation zone 31 is carried via line 32 and is admixed with a hot vapor stream provided via line 20 and the resulting admixture is carried via line 52 and introduced into heat-exchanger 33. The cooled effluent from heat-exchanger 33 is carried via line 34 and is admixed with a wash water stream provided via line 53 and the resulting admixture is introduced into vapor-liquid separator 35 via line 54. A spent aqueous wash water stream is removed from vapor-liquid separator 35 via line 36 and recovered. A hydrogen-rich gaseous stream containing hydrogen sulfide is removed from vapor-liquid separator 35 via line 37 and introduced into acid gas scrubber 38. A lean aqueous adsorbent is introduced into acid gas scrubber 38 via line 39 and a rich aqueous adsorbent is removed from acid gas scrubber 38 via line 40 and recovered. A hydrogen-rich gaseous stream containing a reduced concentration of hydrogen sulfide is removed from acid gas scrubber 38 via line 41 and introduced into compressor 42. A compressed hydrogen-rich gaseous stream is carried from compressor 42 via line 43 and bifurcated into line 44 which is introduced into hydrocracking zone 4 via lines 44 and 3. Another portion of the hydrogen-rich gaseous stream is carried via line 45 and introduced into heat-exchanger 33. A resulting heated hydrogen-rich gaseous stream is removed from heat-exchanger 33 via line 46 and introduced into heat-exchanger 7 which is located in an upper end of stripping zone 6. A heated hydrogen-rich gaseous stream is removed from heat-exchanger 7 via line 47 and introduced into a lower end of stripping zone 6 as described hereinabove. A liquid hydrocarbonaceous stream is removed from vapor-liquid separator 35 via line 48 and introduced into low pressure flash zone 49. A normally gaseous hydrocarbonaceous stream is removed from low pressure flash zone 49 via line 50 and recovered. A liquid hydrocarbonaceous stream is removed from low pressure flash zone 49 via line 51 and introduced into fractionation zone 26. A low molecular weight stream is removed from fractionation zone 26 via line 27 and recovered. A liquid hydrocarbon stream boiling in the range lower than lube basestock is removed from fractionation zone 26 via line 28 and recovered. A liquid hydrocarbonaceous stream containing lube basestock components is removed from fractionation zone 26 via line 29. A liquid hydrocarbonaceous stream containing lube basestock components is removed from stripping zone 6 via line 9 and bifurcated. A portion is transported via line 10 and is introduced into hydrocracking zone 4 via lines 2 and 3 as hereinabove described. Another portion is transported via line 11 and is admixed with a make-up hydrogen stream provided via line 12 and the resulting admixture is carried via line 13 and is admixed with a hydrocarbon stream provided via line 29 as hereinabove described. The resulting admixture is carried via line 14 and introduced into hydrodewaxing zone 15. A hydrocarbon stream containing a reduced concentration of wax is removed from hydrodewaxing zone 15 via line 16 and introduced into hydrofinishing zone 17. An effluent stream from hydrofinishing zone 17 is carried via line 18 and introduced into hot separation zone 19. A gaseous stream is removed from hot separation zone 19 via line 20 and is contacted with the effluent from the aromatic saturation zone 31 as hereinabove described. A liquid hydrocarbonaceous stream containing lube basestock components is removed from hot separation zone 19 via line 21 and is introduced into stripping zone 22. Steam is introduced into stripping zone 22 via line 23 which produces a vapor stream carried via line 25 which is introduced into fractionation zone 26. A liquid hydrocarbon stream containing lube basestock is removed from stripper 22 via line 24 and recovered.

The process of the present invention is further demonstrated by the following illustrative embodiment. This illustrative embodiment is, however, not presented to unduly limit the process of this invention, but to further illustrate the advantage of the hereinabove-described embodiment. The following data were not obtained by the actual performance of the present invention but are considered prospective and reasonably illustrative of the expected performance of the invention.

ILLUSTRATIVE EMBODIMENT

A hydrocracker feedstock in an amount of 100 mass units (MU) having the characteristics presented in Table 1 is hydrocracked in a single stage hydrocracker at operating conditions presented in Table 2 to yield a hydrocracking zone effluent which is introduced into a hot, high-pressure stripper which is stripped with a hot hydrogen stream of 3000 SCFB based on the fresh feedstock. A vapor stream containing hydrogen, hydrogen sulfide and hydrocarbonaceous compounds boiling at a temperature below that of the lube basestock hydrocarbons is removed overhead from the high-pressure stripper lo and introduced into a post-treat hydrogenation zone to saturate aromatic compounds which zone is operated at a temperature of about 680° F. to nominally saturate 40% of the aromatic compounds. The resulting effluent from the post-treat zone is partially condensed and introduced into a cold vapor-liquid separator operated at about 130° F. A hydrogen-rich gaseous stream is removed from the cold vapor-liquid separator and contacted with a lean amine solution to produce a resulting hydrogen-rich gaseous stream containing less than about 50 ppm sulfur. A first portion of the low sulfur hydrogen-rich gaseous stream is passed to the hydrocracking reaction zone and a second portion is heat exchanged with the effluent from the post-treat zone and then heat exchanged with the upwardly flowing gaseous stream in the hot, high-pressure stripper to produce internal reflux in the stripper. The resulting heated, hydrogen-rich gaseous stream is introduced into the lower end of the stripper to provide stripping gas and a countercurrently flowing hydrogen-rich stream in a catalytic hydrogenation zone located in the lower end of the stripper. The downwardly flowing liquid containing lube basestock boiling components is passed through the hereinabove-mentioned catalytic hydrogenation zone with countercurrent hydrogen flow at a temperature of about 720° F. A first portion of the low sulfur containing hydrocarbons produced as stripper bottoms is recycled to the hydrocracking reaction zone in an amount of about 45 mass units and a second portion in an amount of 76 mass units is admixed with makeup hydrogen in an amount of about 2.2 mass units and introduced into a hydrodewaxing zone operated at a temperature of about 700° F. to reduce the pour point of lube basestock hydrocarbons passing therethrough to about 0° F. The resulting effluent from the hydrodewaxing zone is passed to a hydrofinishing reactor operated at about 625° F. to improve the color and other characteristics of the lube basestock hydrocarbons and subsequently passed to a hot, high-pressure vapor-liquid separator. A vapor stream from the hot, high-pressure vapor-liquid separator is cooled and introduced into the hereinabove-described cold, vapor-liquid separator. A hot liquid stream containing lube basestock hydrocarbons is passed from the hot, high-pressure vapor-liquid separator to a steam stripping zone to remove lower boiling hydrocarbons overhead for subsequent introduction to a hereinafter-described fractionation zone. A lube basestock stream in an amount of 75 mass units is removed from the steam stripping zone and recovered.

A liquid hydrocarbonaceous stream is removed from the cold vapor-liquid separator and introduced into a cold flash drum to remove normally gaseous hydrocarbons and dissolved hydrogen, and the resulting liquid is introduced into a fractionation zone to produce a naphtha product stream (4 mass units), a diesel product stream (18 mass units) and a recycle stream (5 mass units) which is passed to the hydrodewaxing zone.

TABLE 1

HYDROCRACKER FEEDSTOCK ANALYSIS

| Straight Run Vacuum Gas Oil | |
|---|---|
| Gravity, ° API | 21 |
| Distillation, Volume Percent | |
| IBP, ° F. | 664 |
| 10 | 716 |
| 30 | 767 |
| 50 | 817 |
| 70 | 880 |
| 90 | 965 |
| FBP | 1050 |
| Sulfur, weight percent | 2.5 |
| Nitrogen, PPM | 900 |
| Pour Point, ° F. | 120 |

TABLE 2

SUMMARY OF HYDROCRACKING ZONE OPERATING CONDITIONS

| Reactor Operating Conditions | |
|---|---|
| Hydrogen Pressure, PSIA | 1800 |
| Space Velocity | 1.5 |
| Temperature, ° F. | 725 |
| Conversion Per Pass * | 15% |
| Recycle Hydrogen to Oil Ratio, SCFB | 8500 |
| Total (Gross) Conversion, % * | 25 |

* Conversion to 662° F. end point distillate and lighter

The foregoing description, drawing and illustrative embodiment clearly illustrate the advantages encompassed by the process of the present innovation and the benefits to be afforded with the use thereof.

What is claimed:

1. A method to produce lube oil basestock from a hydrocarbonaceous feedstock which method comprises:

(a) contacting the hydrocarbonaceous feedstock and a first hydrogen-rich gaseous stream in a hydrocracking zone with a hydrocracking catalyst at a temperature from about 400° F. to about 900° F., a pressure from about 500 psig to about 2500 psig, and a liquid hourly space velocity from about 0.1 $hr^{-1}$ to about 15 $hr^{-1}$;

(b) passing an effluent stream from the hydrocracking zone directly to a hot, high-pressure stripper utilizing a hot, hydrogen-rich stripping gas to produce a vapor stream comprising hydrogen, hydrogen sulfide, ammonia and hydrocarbonaceous compounds boiling at a temperature below the boiling range of lube basestock, and a liquid stream saturated with hydrogen and comprising hydrocarbonaceous compounds boiling in the range of lube basestock;

(c) introducing the vapor stream comprising hydrogen, hydrogen sulfide, ammonia and hydrocarbonaceous compounds boiling at a temperature below the boiling range of lube basestock into a hydrogenation zone containing hydrogenation catalyst;

(d) partially condensing a resulting effluent from the hydrogenation zone to produce a second hydrogen-rich gaseous stream and a liquid hydrocarbonaceous stream;

(e) passing at least a portion of the liquid stream and a third hydrogen-rich gaseous stream to a catalytic hydrodewaxing zone to reduce the pour point of the liquid stream; and (f) separating a resulting effluent from the catalytic hydrodewaxing zone to produce lube basestock.

2. The process of claim 1 wherein at least a portion of the vapor stream produced in step (b) is recycled to the hydrocracking zone to provide at least a portion of the first hydrogen-rich gaseous stream.

3. The process of claim 1 wherein at least a portion of the hydrocarbonaceous feedstock boils in the range from about 450° F. to about 1050° F.

4. The process of claim 1 wherein the hot, high-pressure stripper is operated at a temperature and pressure which is essentially equal to that of the hydrocracking zone.

5. The process of claim 1 wherein the hot, high-pressure stripper is operated at a temperature no less than about 100° F. below the outlet temperature of the hydrocracking zone and at a pressure no less than about 100 psig below the outlet pressure of the hydrocracking zone.

6. The process of claim 1 wherein at least a portion of the vapor stream produced in step (b) is utilized as stripping gas in the hot, high-pressure stripper.

7. The process of claim 1 wherein the catalytic hydrodewaxing zone is operated at a temperature from about 250° F. to about 850° F., a pressure from about 500 psig to about 2500 psig and a liquid hourly space velocity from about 0.1 to about 15.

8. The process of claim 1 wherein at least a portion of the liquid stream is passed to the hydrocracking zone.

9. The process of claim 1 wherein a resulting effluent from the catalytic hydrodewaxing zone is directly introduced into a hydrofinishing reaction zone and a resulting effluent is separated to produce lube basestock.

10. The process of claim 9 wherein the hydrofinishing reaction zone is operated at a temperature from about 250° F. to about 700° F. and a pressure from about 500 psig to about 2500 psig.

11. The process of claim 1 wherein the catalytic hydrodewaxing zone contains a catalyst comprising a noble metal.

12. A method to produce lube oil basestock from a hydrocarbonaceous feedstock which method comprises:

(a) contacting the hydrocarbonaceous feedstock and a first hydrogen-rich gaseous stream in a hydrocracking zone with a hydrocracking catalyst at a temperature from about 400° F. to about 900° F., a pressure from about 500 psig to about 2500 psig, and a liquid hourly space velocity from about 0.1 $hr^{-1}$ to about 15 $hr^{-1}$;

(b) passing an effluent stream from the hydrocracking zone directly to a hot, high-pressure stripper utilizing a hot, hydrogen-rich stripping gas to produce a vapor stream comprising hydrogen, hydrogen sulfide, ammonia and hydrocarbonaceous compounds boiling at a temperature below the boiling range of lube basestock, and a downwardly flowing liquid comprising hydrocarbonaceous compounds boiling in the range of lube basestock;

(c) simultaneously contacting the downwardly flowing liquid in the hot, high-pressure stripper with a hydrogenation catalyst and an upwardly flowing hydrogen stream to produce a liquid stream saturated with hydrogen and comprising hydrocarbonaceous compounds boiling at a temperature in the range of lube basestock;

(d) passing at least a portion of the liquid stream and a second hydrogen-rich gaseous stream to a catalytic hydrodewaxing zone to reduce the pour point of the liquid stream;

(e) introducing the vapor stream comprising hydrogen, hydrogen sulfide, ammonia and hydrocarbonaceous compounds boiling at a temperature below the boiling range of lube basestock into a hydrogenation zone containing hydrogenation catalyst;

(f) partially condensing a resulting effluent from the hydrogenation zone to produce a third hydrogen-rich gaseous stream and a liquid hydrocarbonaceous stream; and (g) separating a resulting effluent from the catalytic hydrodewaxing zone to produce lube basestock.

13. The process of claim 12 wherein at least a portion of the vapor stream produced in step (b) is recycled to the hydrocracking zone to provide at least a portion of the first hydrogen-rich gaseous stream.

14. The process of claim 12 wherein at least a portion of the hydrocarbonaceous feedstock boils: in the range from about 450° F. to about 1050° F.

15. The process of claim 12 wherein the hot, high-pressure stripper is operated at a temperature and pressure which is essentially equal to that of the hydrocracking zone.

16. The process of claim 12 wherein the hot, high-pressure stripper is operated at a temperature no less than about 100° F. below the outlet temperature of the hydrocracking zone and at a pressure no less than about 100 psig below the outlet pressure of the hydrocracking zone.

17. The process of claim 12 wherein at least a portion of the vapor stream produced in step (b) is utilized as stripping gas in the hot, high-pressure stripper.

18. The process of claim 12 wherein the catalytic hydrodewaxing zone is operated at a temperature from about 250° F. to about 850° F., a pressure from about 500 psig to about 2500 psig and a liquid hourly space velocity from about 0.1 to about 15.

19. The process of claim 12 wherein at least a portion of the liquid stream is passed to the hydrocracking zone.

20. The process of claim 12 wherein a resulting effluent from the catalytic hydrodewaxing zone is directly introduced into a hydrofinishing reaction zone and a resulting effluent is separated to produce lube basestock.

21. The process of claim 20 wherein the hydrofinishing reaction zone is operated at a temperature from about 250° F. to about 700° F. and a pressure from about 500 psig to about 2500 psig.

22. The process of claim 12 wherein the catalytic hydrodewaxing zone contains a catalyst comprising a noble metal.

23. A method to produce lube oil basestock from a hydrocarbonaceous feedstock which method comprises:

(a) contacting the hydrocarbonaceous feedstock and a first hydrogen-rich gaseous stream in a hydrocracking zone with a hydrocracking catalyst at a temperature from about 400° F. to about 900° F., a pressure from about 500 psig to about 2500 psig, and a liquid hourly space velocity from about 0.1 $hr^{-1}$ to about 15 $hr^{-1}$;

(b) passing an effluent stream from the hydrocracking zone directly to a hot, high-pressure stripper utilizing a hot, hydrogen-rich stripping gas to produce a vapor stream comprising hydrogen, hydrogen sulfide, ammonia and hydrocarbonaceous compounds boiling at a temperature below the boiling range of lube basestock, and a downwardly flowing liquid comprising hydrocarbonaceous compounds boiling in the range of lube basestock;

(c) simultaneously contacting the downwardly flowing liquid in the hot, high-pressure stripper with a hydrogenation catalyst and an upwardly flowing hydrogen stream to produce a liquid stream saturated with hydrogen and comprising hydrocarbonaceous compounds boiling at a temperature in the range of lube basestock;

(d) passing at least a portion of the liquid stream and a second hydrogen-rich gaseous stream to a catalytic hydrodewaxing zone to reduce the pour point of the liquid stream;

(e) passing an effluent directly from the catalytic hydrodewaxing zone into a hydrofinishing reaction zone;

(f) introducing the vapor stream comprising hydrogen, hydrogen sulfide, ammonia and hydrocarbonaceous compounds boiling at a temperature below the boiling range of lube basestock into a hydrogenation zone containing hydrogenation catalyst;

(g) partially condensing a resulting effluent from the hydrogenation zone to produce a third hydrogen-rich gaseous stream and a liquid hydrocarbonaceous stream; and (h) separating a resulting effluent from the hydrofinishing reaction zone to produce lube basestock.

24. The process of claim 23 wherein the catalytic hydrodewaxing zone contains a catalyst comprising a noble metal.

25. The process of claim 23 wherein at least a portion of the vapor stream produced in step (b) is recycled to the hydrocracking zone to provide at least a portion of the first hydrogen-rich gaseous stream.

26. The process of claim 23 wherein at least a portion of the hydrocarbonaceous feedstock boils in the range from about 450° F. to about 1050° F.

27. The process of claim 23 wherein the hot, high-pressure stripper is operated at a temperature and pressure which is essentially equal to that of the hydrocracking zone.

28. The process of claim 23 wherein the hot, high-pressure stripper is operated at a temperature no less than about 100° F. below the outlet temperature of the hydrocracking zone and at a pressure no less than about 100 psig below the outlet pressure of the hydrocracking zone.

29. The process of claim 23 wherein at least a portion of the vapor stream produced in step (b) is utilized as stripping gas in the hot, high-pressure stripper.

30. The process of claim 23 wherein the catalytic hydrodewaxing zone is operated at a temperature from about 250° F. to about 850° F., a pressure from about 500 psig to about 2500 psig and a liquid hourly space-velocity from about 0.1 to about 15.

31. The process of claim 23 wherein at least a portion of the liquid stream is passed to the hydrocracking zone.

32. The process of claim 23 wherein the hydrofinishing reaction zone is operated at a temperature from about 250° F. to about 700° F. and a pressure from about 500 psig to about 2500 psig.

* * * * *